US005161309A

United States Patent [19]

Graves

[11] Patent Number: 5,161,309

[45] Date of Patent: Nov. 10, 1992

[54] PREDATOR DEFENSE SWIM FIN

[76] Inventor: David A. Graves, 3631 E. 55th St., Tulsa, Okla. 74135

[21] Appl. No.: 873,784

[22] Filed: Apr. 27, 1992

[51] Int. Cl.[5] ..... B26B 27/00; B26B 3/00; A63B 31/08; A63B 27/00

[52] U.S. Cl. ..... 30/297; 30/299; 441/64; 182/134

[58] Field of Search ..... 30/158, 159, 160, 296, 30/297; 441/61, 64, 76; 7/167, 116; 182/134, 221

[56] References Cited

U.S. PATENT DOCUMENTS

| | | | |
|---|---|---|---|
| 3,084,355 | 4/1963 | Ciccotelli | 441/61 |
| 3,521,312 | 7/1970 | Ganev | 441/64 |
| 4,555,848 | 12/1985 | Schultz | 30/297 |
| 4,623,037 | 11/1986 | Kincaid | 182/134 |
| 5,058,278 | 10/1991 | Colvin | 30/299 |

*Primary Examiner*—Douglas D. Watts
*Assistant Examiner*—Paul M. Heyrana, Sr.
*Attorney, Agent, or Firm*—Molly D. McKay; William S. Dorman

[57] ABSTRACT

The present invention is a swim fin equipped with extendable knives which can be used by a diver to fight off an attack by a predatory underwater creature, such as a shark. The knives, when in their locked closed positions, lie in a recessed section provided in an outside edge of the swim fin. In their locked closed positions, the knives lie parallel with a bottom surface of the swim fin. When extended to their locked open positions, the knives point downward from the swim fin. The swim fin is provided with means for locking the knives in their open and closed positions, unlocking the knives from their locked open and locked closed positions, and moving the knives between their open and closed positions.

8 Claims, 3 Drawing Sheets

PREDATOR DEFENSE SWIM FIN

BACKGROUND OF THE INVENTION

1. Field of the Invention

The present invention is a swim fin equipped with extendable blades which are locked closed for normal use of the swim fin and moved into a locked open position in order for the diver to use his feet to fight off an attacking shark or other underwater predatory creature. More specifically, the swim fin has blades which lock closed in positions where the blades lie in a parallel arrangement with a bottom surface of the swim fin and which lock open in positions where the blades extend downward at various angles from the bottom surface of the swim fin.

2. The Prior Art

A preliminary search was conducted on the invention disclosed herein, and the following listed patents were uncovered in the search:

| Patent No. | Inventor | Issue Date |
|---|---|---|
| 844,625 | W. L. Spencer | Feb. 19, 1907 |
| 2,016,249 | W. M. Bashlin | Oct. 1, 1935 |
| 2,362,518 | R. L. Woodbury | Nov. 14, 1944 |
| 2,665,478 | A. Clemens | Jan. 12, 1954 |
| 2,835,426 | R. A. Terry | May 20, 1958 |
| 3,581,326 | R. R. Hayes | June 1, 1971 |
| 4,555,848 | C. J. Schultz | Dec. 3, 1985 |
| 4,623,037 | W. J. Kincaid | Nov. 18, 1986 |
| 5,033,142 | L. W. Templeton | July 23, 1991 |
| 5,058,278 | T. C. Colvin | Oct. 22, 1991 |

A diver who swims in the ocean may be attacked by sharks or other predatory creatures. When such an attack occurs, the diver will generally try to ward off the attack using his feet. The feet are less vulnerable to injury than the hands because of the rubber fins which cover the diver's feet. Also, the muscle groups located in the diver's legs are normally stronger than those in the diver's arms and are better able to mount a vigorous or sustained underwater defense. Finally, the legs are the body's appendages which are located furthest away from the diver's head and chest, the areas most vital to sustaining the diver's life.

Prior art swim fins are constructed of smooth rubber or other similar material so they will glide through the water with a minimum of resistance and will not injure the diver's ankles and legs. In the event of an attack by an underwater predator, prior art swim fins provide only a protective covering for the feet and do not provide the diver with any other defensive capabilities against the predator.

Diving tools, such as U.S. Pat. Nos. 3,581,326 and 5,033,142, do provide a diver with offensive capabilities against a predator. However, these tools are designed to be used in the diver's unprotected hand. Use of one of these hand-held diving tools utilizes weaker muscles than those found in the diver's legs, and requires the diver to allow the predator to move close to the diver's head and chest areas in order for the diver to strike a blow to the predator.

The present invention overcomes the problems associated with a diver using prior art swim fins and hand-held diving tools to defend himself from a predator's attack. The present invention is a swim fin with knives safely locked in closed positions within a recessed section of the swim fin. The knives can be rapidly extended by the diver into a locked open position where the knives point in a downward direction from the bottom surface of the swim fin, thus providing the diver with enhanced defensive capabilities against an attacking predator.

SUMMARY OF THE INVENTION

The present invention is a swim fin for providing defensive protection to a diver from underwater predatory creatures, such as sharks. The swim fin is provided with knives movable between locked closed positions and locked open positions. In the locked closed positions, the knives lie parallel with a bottom surface of the swim fin and adjacent to each other within a recessed section provided in an outside edge of the swim fin. In the locked open position, a blade end of each of the knives extends downward from the swim fin's bottom surface.

Each knife is provided with a rounded swivel end located opposite the blade end. Unsharpened indented areas are provided on a bottom edge and a top edge of each knife between the blade and rounded swivel ends of the knife. The outside edge of the swim fin is provided with a knife blade access opening which provides access to the unsharpened indented areas of the knives. By pushing downward on the unsharpened indented areas, a diver can release the knives from their locked closed positions and move them into their locked open positions.

A base plate attaches within the recessed section so that it lies perpendicular to the bottom surface of the swim fin. A knife blade axle attaches perpendicularly to the base plate. Knives attach to the knife blade axle by means of openings provided in the rounded swivel end of each knife. A first washer is provided on the knife blade axle between the base plate and a first knife. A second knife lies between the first knife and a third knife, and a fourth knife lies adjacent to the third knife. A second washer is provided between the fourth knife and a nut which secures the knives on the knife blade axle. A cotter pin inserts through a hole in the knife blade axle, said hole being located adjacent to the nut on a side of the nut opposite the second washer. A cotter pin pull ring is provided on the cotter pin to facilitate removal of the cotter pin from the hole.

A spring latch base attaches perpendicularly to the base plate and is encircled with four spring latches, one associated with each knife. The spring latches are provided with spring latch blocks to hold them stationary and are provided with flexible spring latch tips which engage closed position notches and open position notches provided on the rounded swivel end of each of their associated knives. Each of the open position notches is provided with a flattened side to enable a diver to release the knife from its locked closed position by pushing downward on the knife.

A release mechanism attaches to the spring latches between the spring latch base and the spring latch tips. A vertical extension, having a lower end and an upper end, attaches by its lower end to the release mechanism. The upper end of the vertical extension extends upward through a rectangular window provided in the outside edge of the swim fin. The upper end is attached to a vertical extension pull ring by which a diver can lift the spring latch tips to unlock the knives from their locked open positions. A vertical extension block is provided on the vertical extension between the lower end of the vertical extension and the outside edge of the swim fin.

DETAILED DESCRIPTION OF THE PREFERRED EMBODIMENTS

Figure 1:
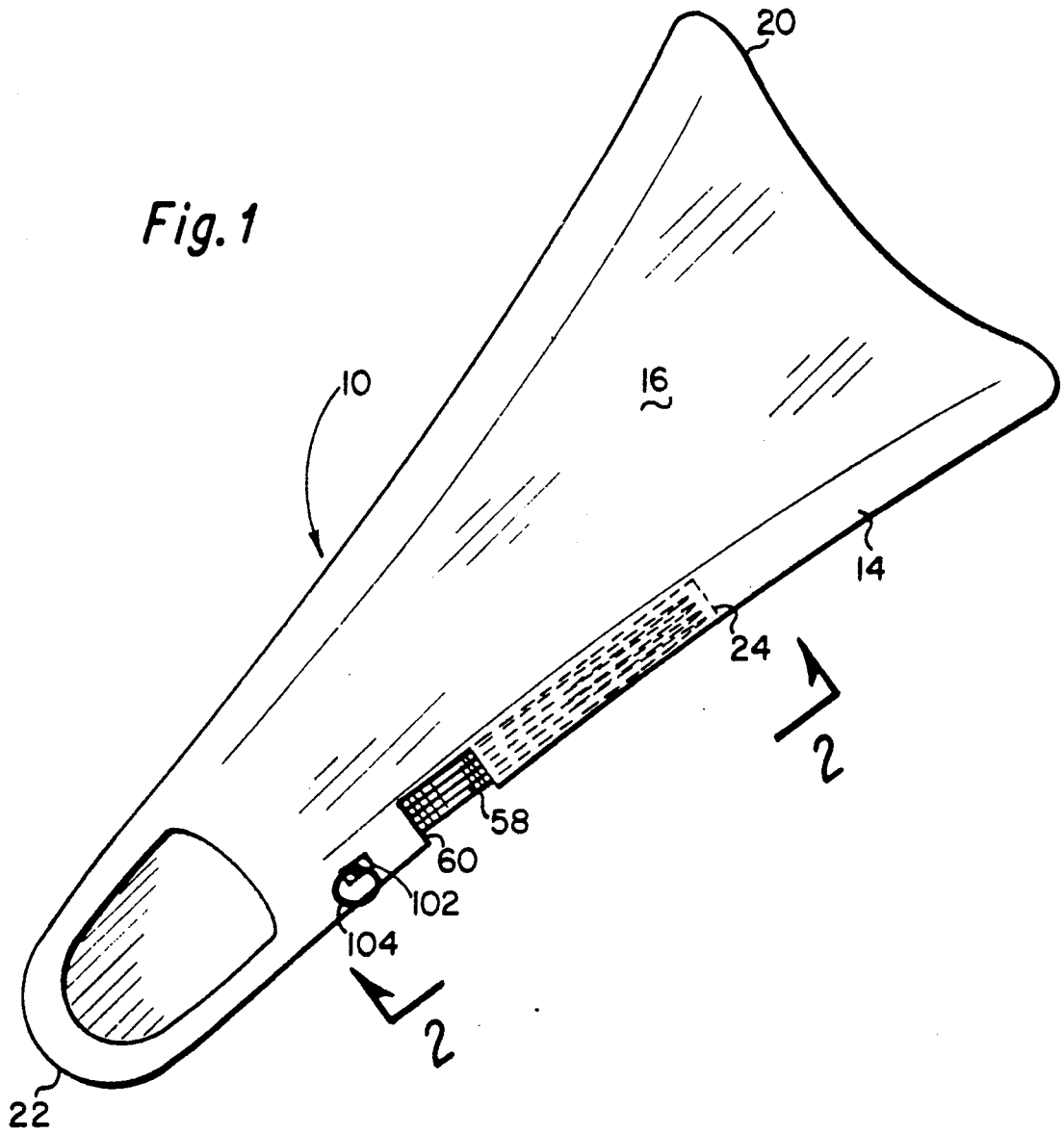
FIG. 1 is a top plan view of a predator defense swim fin constructed in accordance with a preferred embodiment of the present invention.
Figure 3:
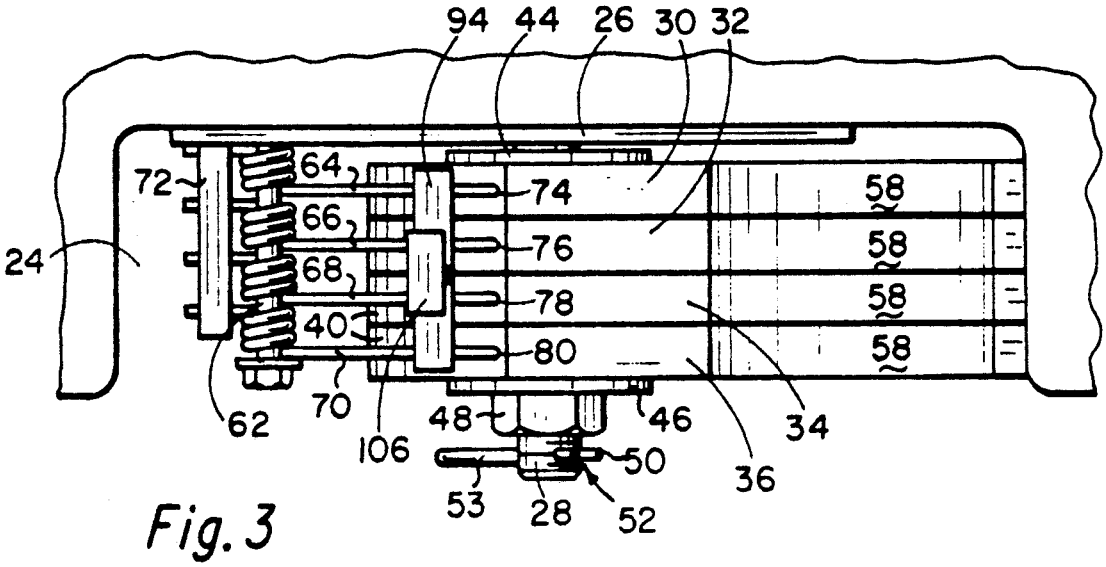
FIG. 3 is a cross-sectional view of the predator defense swim fin taken along line 3—3 of FIG. 2.
Figure 8:
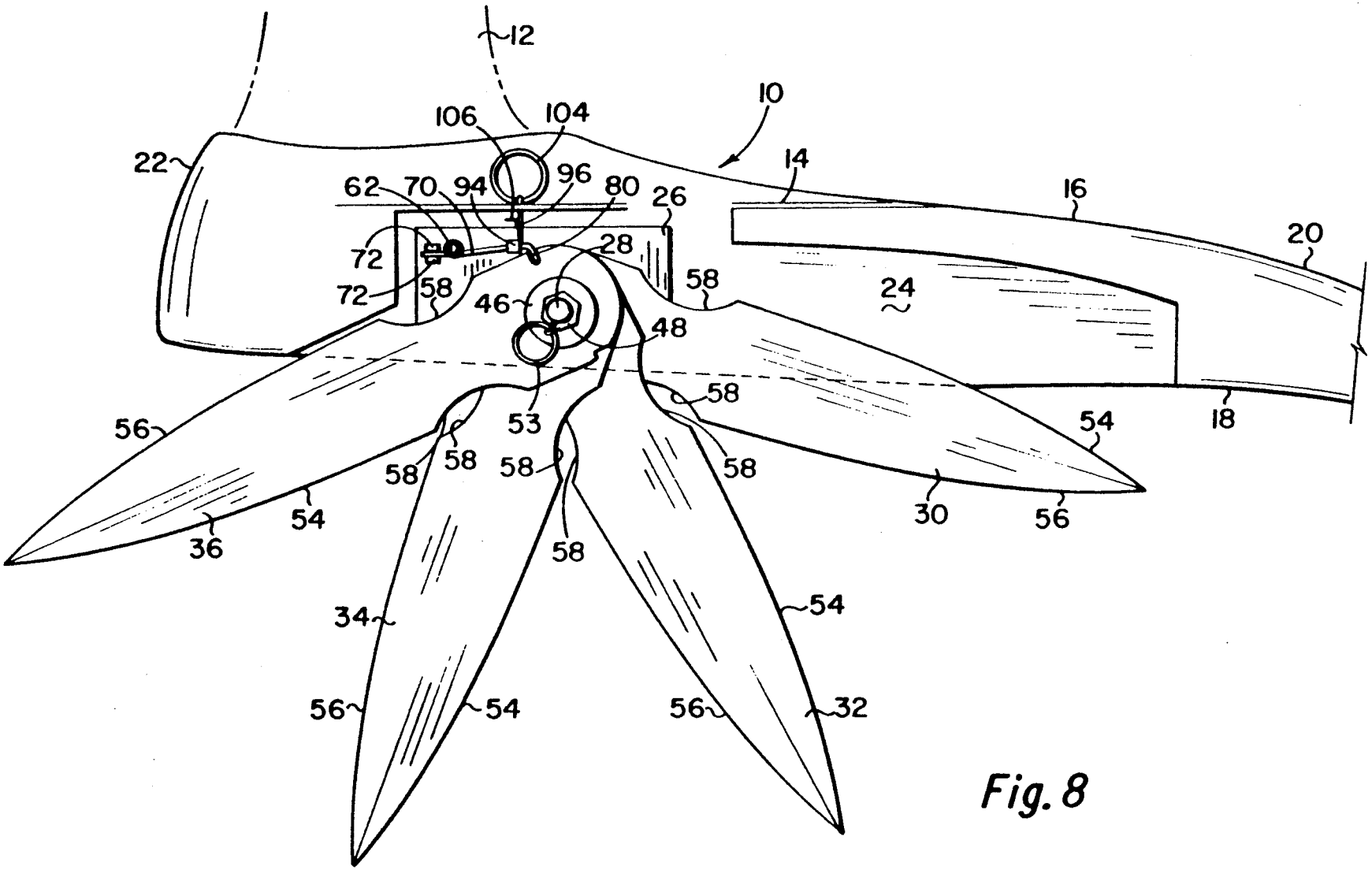
FIG. 8 is a right side elevation of the predator defense swim fin showing the knives in their locked open positions.

Referring now to the drawings and initially to FIGS. 1 and 8, there is illustrated a predator defense swim fin, generally designated by reference numeral 10. The swim fin 10 is worn on a diver's foot 12.

The swim fin 10 is provided with an outside edge 14, a top surface 16, a bottom surface 18, a toe end 20 and a heel end 22. The bottom surface 18 is provided with a recessed section 24 which lies adjacent to and parallel with the outside edge 14.

Now referring to FIGS. 2 through 8, a base plate 26 is attached in the recessed section 24 near the heel end 22. The base plate 26 lies perpendicular to the bottom surface 18 of the swim fin 10. A knife blade axle 28 is attached perpendicularly to the base plate 26. The knife blade axle 28 is made from a machine bolt or other similar entity. A first knife 30, a second knife 32, a third knife 34 and a fourth knife 36, each having a sharp blade end 38 and an opposite rounded swivel end 40, are movably positioned on the knife blade axle 28 by means of openings 42 provided in the rounded swivel ends 40 of the knives 30 through 36. The knives 30, 32, 34 and 36 lie adjacent to each other in a parallel arrangement within the recessed section 24. The knives 30, 32, 34 and 36 are parallel with the outside edge 14, with the first knife 30 lying inner most within the recessed section 24, the second knife 32 lying adjacent to the first knife 30, the third knife 34 lying between the second and fourth knives 32 and 36, and the fourth knife 36 lying outer most within the recessed section 24. A first washer 44 lies between the base plate 26 and the first knife 30, and a second washer 46 lies between the fourth knife 36 and a nut 48 which secures the knives 30 through 36 to the axle 28. A cotter pin 50 inserts through a hole 52 provided in the axle 28 adjacent to the nut 48 and on a side of the nut 48 opposite the second washer 46. The cotter pin 50 prevents the nut 48 from accidentally coming off the knife blade axle 28. A cotter pin pull ring 53 is provided on the cotter pin 50 to facilitate removal of the cotter pin 50 from the hole 52.

Knives 30 through 36 can be removed from the swim fin 10 so they can be used by hand. Removal is accomplished by removing the cotter pin 50 from the hole 52, removing the nut 48, and slipping the knives 30 through 36 off the knife blade axle 28.

Each of the knives 30 through 36 is provided with a top edge 54 and a bottom edge 56. An unsharpened indented area 58 is provided on each of the top edges 54 and on each of the bottom edges 56. Said unsharpened indented areas 58 are located between the blade end 38 and the swivel end 40 of each of the knives 30 through 36 and serve as finger grooves for opening and closing the knives 30 through 36.

Figure 2:
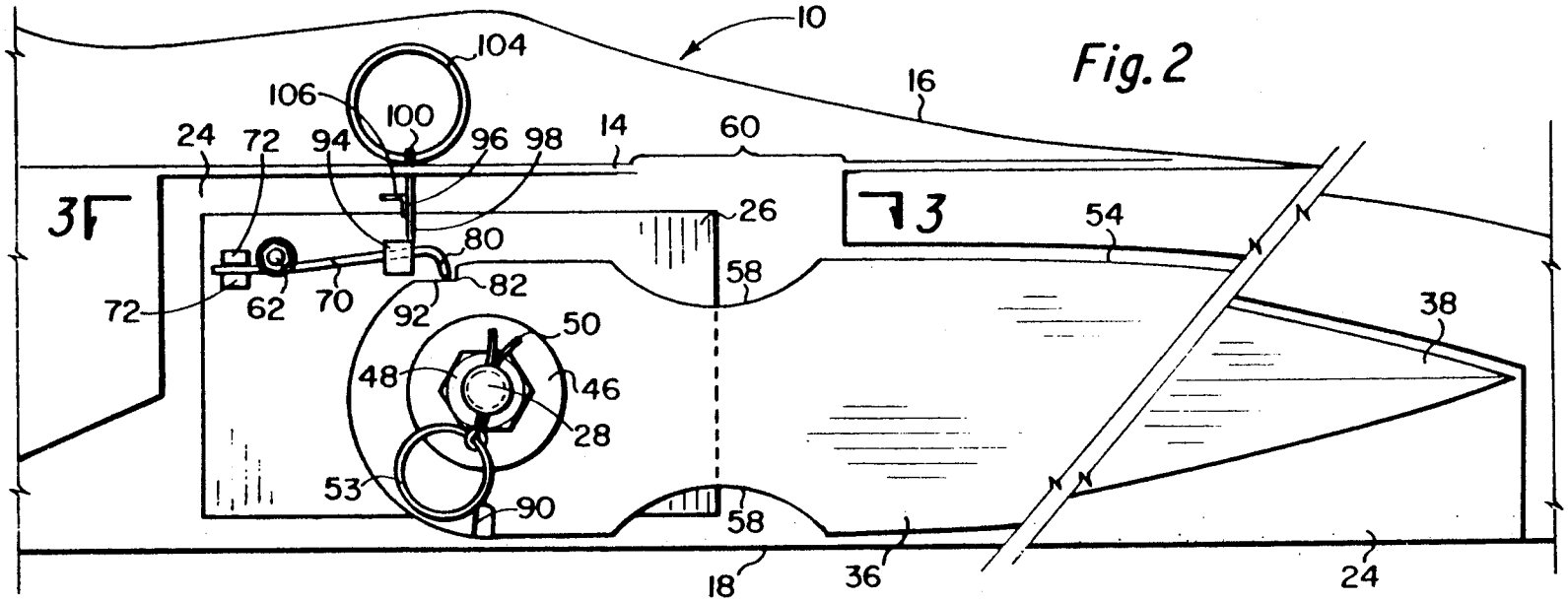
FIG. 2 is a right side elevation of the predator defense swim fin taken along line 2—2 of FIG. 1.
Figure 6:
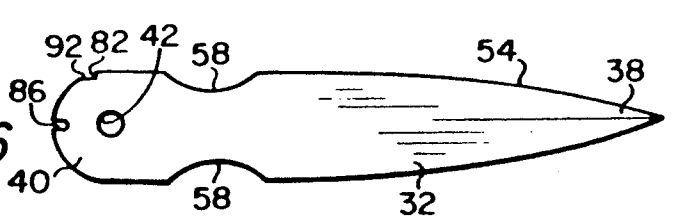
FIG. 6 is a right side elevation of the second knife.
Figure 7:
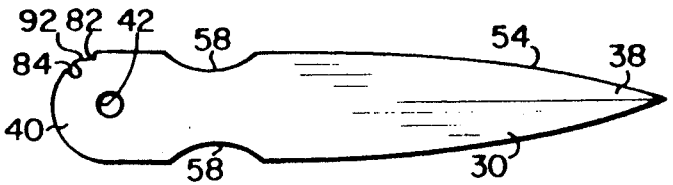
FIG. 7 is a right side elevation of the first knife.
Figure 4:
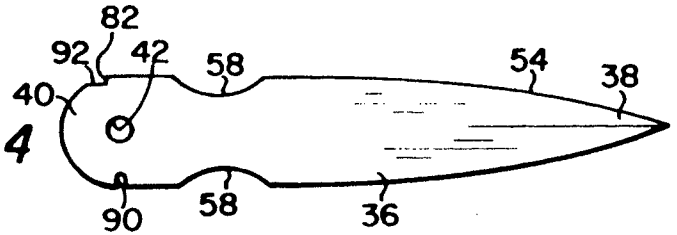
FIG. 4 is a right side elevation of the fourth knife.
Figure 5:
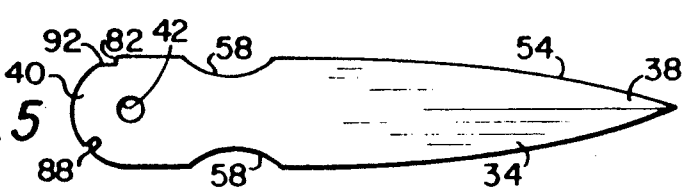
FIG. 5 is a right side elevation of the third knife.

A knife blade access opening 60 is provided in the outside edge 14 of the swim fin 10 to provide finger access to the unsharpened indented areas 58 of the knives 30 through 36, thus allowing the knives 30 through 36 to be pushed downward from their locked closed positions, as shown in FIG. 2, to their locked open positions, as shown in FIG. 8.

A spring latch base 62 attaches perpendicularly to the base plate 26 and extends parallel with the knife blade axle 28. Four latches 64, 66, 68 and 70 encircle the spring latch base 62. The latches 64 through 70 are provided with spring latch blocks 72 which serve to maintain the spring latches 64 through 70 in fixed, stationary positions.

Each latch 64, 66, 68 and 70 is provided with a spring latch tip 74, 76, 78 and 80, respectively. The tips 74, 76, 78 and 80 press against the swivel ends 40 of the knives 30, 32, 34 and 36, respectively. The tips 74 through 80 are positioned so that they press downward against the rounded swivel ends 40 of the knives 30 through 36 at points slightly closer to the heel end 22 than where the knife blade axle 28 is located. The rounded swivel end 40 of each knife 30, 32, 34 and 36 is provided with two notches, a closed position notch 82 and an open position notch 84, 86, 88 and 90, respectively.

The closed position notches 82 are all located in identical places on the knives 30 through 36. Each of the closed position notches 82 has a flattened side 92 which is engaged by the corresponding tip 74, 76, 78 or 80, thus locking each of the knives 30 through 36 in its closed position.

The flattened sides 92 allow the knives 30 through 36 to be moved out of their closed position and downward with respect to the swim fin 10 when a sufficient downward force is applied to the knives 30 through 36, such as when a diver pushes downward on the unsharpened indented areas 58 provided on the top edges 54 of the knives 30 through 36. The knives 30 through 36 are moved from their locked closed positions by pushing them downward and toward the heel end 22 until they reach their locked open positions.

The open position notches 84, 86, 88 and 90 are so located on the rounded swivel ends 40 of the knives 30, 32, 34 and 36 that when the tips 74, 76, 78 and 80 engage the notches 84, 86, 88 and 90, the knives 30, 32, 34 and 36 are extended at 15°, 70°, 115° and 155°, respectively, from the bottom surface 18 as viewed from the toe end 20 of the swim tin 10. The open position notches 84 through 90 are designed so that once they are locked in their open positions, the knives 30 through 36 cannot be moved without lifting the tips 74 through 80 upward out of the open position notches 84 through 90.

A release mechanism 94, which functions to lift the tips 74 through 80 upward out of the open position notches 84 through 90, attaches to the spring latches 64 through 70 between the spring latch base 62 and the tip ends 74 through 80. A vertical extension 96, having a lower end 98 and an upper end 100, attaches by its lower end 98 to the release mechanism 94 and extends upward through a rectangular window 102 provided in the outside edge 14 of the swim fin 10. The upper end 100 is located above the outside edge 14 of the swim fin 10 and attaches to a vertical extension pull ring 104. The vertical extension 96 is provided with a vertical extension block 106 located between the release mechanism 94 and the rectangular window 102. The purpose of the vertical extension block 106 is to bump against the outside edge 14, thus preventing the spring latches 64 through 70 from being damaged by being pulled upward too far when the release mechanism 94 is employed.

To release the knives 30 through 36 from their locked open position, a diver pulls upward on the vertical extension pull ring 104 to lift the tips 74 through 80 out of the open position notches 84 through 90. The knives 30 through 36 can then be moved back into their locked closed position by applying a forward and upward pulling force to the unsharpened indented areas 58 provided on the bottom edges 56 of the knives 30 through 36. Although not illustrated in the drawings, the knives 30 through 36 can be covered with sheaths (not shown) while the knives 30 through 36 are located in their locked closed positions. The purpose of the sheaths (not shown) is to protect a diver from accidental injury with the knives 30 through 36. The sheaths (not shown) are removed when the knives 30 through 36 are opened. Although the present invention has been described as having four knives, other embodiment having one or more knives can be made according to the present invention. Whereas, the present invention has been described in particular relation to the drawings attached hereto, it should be understood that other and further modifications, apart from those shown or suggested herein, may be made within the spirit and scope of this invention.

What is claimed is:

1. A predator defense swim fin to be worn on a diver's foot which can be used by the diver to fight off predatory underwater creatures comprising:

a swim fin provided with at least one knife movably mounted onto the swim fin, each knife being movable between a closed position where the knife lies parallel with a bottom surface of the swim fin and an open position where the knife lies pointing downward from the swim fin's bottom surface, means for locking each knife in its closed position, and means for releasing each knife from its locked closed position.

2. A predator defense swim fin according to claim 1 further comprising:

a recessed section being provided in an outside edge of the swim fin, a base plate being attached to the swim fin in the recessed section so that the base plate lies perpendicular to the bottom surface of the swim fin, a knife blade axle being attached perpendicularly to the base plate, the knives being movably mounted on the knife blade axle via an opening provided in a rounded swivel end of each knife.

3. A predator defense swim fin according to claim 2 further comprising:

a first washer being provided on the knife blade axle between the base plate and the knives, a second washer being provided on the knife blade axle between the knives and a nut which holds the knives onto the knife blade axle, the nut being held in place on the knife blade axle by a cotter pin which inserts through a hole provided in the knife blade axle, said hole being located adjacent to the nut on a side of the nut opposite the second washer.

4. A predator defense swim fin according to claim 3 further comprising:

each of the rounded swivel ends being provided with a closed position notch and an open position notch, a spring latch base attached perpendicular to the base plate, a spring latch being provided for each knife, each spring latch encircling the spring latch base, spring latch blocks attached to the spring latches for holding the spring latches stationary, each spring latch provided with a spring latch tip which engages the rounded swivel end of its corresponding knife, the closed position notches being engaged by the spring latch tips to lock the blades in their closed positions, and the open position notches being engaged by the spring latch tips to lock the blades in their open positions.

5. A predator defense swim fin according to claim 4 further comprising:

a release mechanism which attaches to the spring latches between the spring latch base and the spring latch tips, a vertical extension being provided with a lower end and an upper end, said lower end attaching to the release mechanism and said upper end movably extending through a window provided in the outside edge of the swim fin and being attached to a vertical extension pull ring, a vertical extension block being provided on the vertical extension between the release mechanism and the window.

6. A predator defense swim fin according to claim 5 further comprising:

each blade being provided with a blade end located opposite its rounded swivel end, unsharpened indented areas being provided on a top edge and a bottom edge of each knife, said unsharpened indented areas being located on each knife between the knife's rounded swivel end and its blade end.

7. A predator defense swim fin according to claim 6 wherein the outside edge of the swim fin is provided with a knife blade access opening to provide access to the unsharpened indented areas of the knives.

8. A predator defense swim fin according to claim 1 further comprising:

means for locking each knife in its open position, and means for releasing each knife from its locked open position.

* * * * *